US012599185B2

(12) United States Patent
Broster

(10) Patent No.: US 12,599,185 B2
(45) Date of Patent: Apr. 14, 2026

(54) PROTECTIVE KNEE PAD

(71) Applicant: ARMADILLO INDUSTRIAL LIMITED, Macclesfield (GB)

(72) Inventor: Timothy John Broster, Macclesfield (GB)

(73) Assignee: ARMADILLO INDUSTRIAL LIMITED, Maclessfield (GB)

( * ) Notice: Subject to any disclaimer, the term of this patent is extended or adjusted under 35 U.S.C. 154(b) by 103 days.

(21) Appl. No.: 17/416,405

(22) PCT Filed: Dec. 17, 2019

(86) PCT No.: PCT/GB2019/053595
§ 371 (c)(1),
(2) Date: Jun. 18, 2021

(87) PCT Pub. No.: WO2020/128458
PCT Pub. Date: Jun. 25, 2020

(65) Prior Publication Data

US 2022/0071316 A1 Mar. 10, 2022

(30) Foreign Application Priority Data

Dec. 18, 2018 (GB) ..... 1820618

(51) Int. Cl.
*A41D 13/06* (2006.01)
*A41D 13/05* (2006.01)

(52) U.S. Cl.
CPC ..... *A41D 13/065* (2013.01); *A41D 13/0562* (2013.01); *A41D 13/06* (2013.01)

(58) Field of Classification Search
CPC ... A41D 13/0562; A41D 13/06; A41D 13/065
See application file for complete search history.

(56) References Cited

U.S. PATENT DOCUMENTS 4,183,099 A * 1/1980 Lacey ..... A41D 13/065 2/24
5,570,470 A * 11/1996 Miller ..... A41D 13/06 2/22
6,279,160 B1 * 8/2001 Chen ..... A41D 13/065 2/24
6,305,031 B1 * 10/2001 White ..... A63B 71/12 602/61
2003/0024029 A1 * 2/2003 Fiorini ..... A41D 13/065 2/22
2005/0108800 A1 * 5/2005 White ..... A43B 5/00 2/2.5

(Continued)

FOREIGN PATENT DOCUMENTS

DE 8606840 1 U1 4/1986
JP H1046411 A 2/1998

(Continued)

*Primary Examiner* — Katharine G Kane
(74) *Attorney, Agent, or Firm* — Quarles & Brady LLP

(57) ABSTRACT

The invention relates to a protective knee pad (1) for workmen, the protective knee pad comprising a knee support (100) and a protective member (200), said knee support comprising a front portion (10) and a rear portion (20), wherein the knee support is adapted to be wrapped around a user's knee and the protective member comprises a plurality of interconnected overlapping plates (40).

14 Claims, 4 Drawing Sheets

(56) References Cited

U.S. PATENT DOCUMENTS

| | | | | |
|---|---|---|---|---|
| 2008/0021363 | A1 | 1/2008 | Fee | |
| 2008/0096457 | A1* | 4/2008 | Urias | A63H 5/00 446/26 |
| 2008/0178359 | A1* | 7/2008 | Grilliot | A41D 13/05 2/24 |
| 2012/0260392 | A1 | 10/2012 | Votel et al. | |
| 2016/0095363 | A1* | 4/2016 | Alomar, Jr. | A41D 13/065 2/24 |
| 2016/0128859 | A1* | 5/2016 | Brandt | A63B 21/4017 602/63 |
| 2016/0249692 | A1* | 9/2016 | Guidetti | A41D 13/065 2/16 |
| 2017/0049163 | A1 | 2/2017 | Koroly | |
| 2017/0246068 | A1* | 8/2017 | Schultz | A41D 13/08 |

FOREIGN PATENT DOCUMENTS

| | | | |
|---|---|---|---|
| JP | 2003533304 | A | 11/2003 |
| JP | 2006141668 | | 6/2006 |
| JP | 2011041738 | | 3/2011 |
| WO | 0187432 | A2 | 11/2001 |
| WO | 02066122 | A1 | 8/2002 |

* cited by examiner

PROTECTIVE KNEE PAD

CROSS-REFERENCE TO RELATED APPLICATION

This application is a national stage filing under 35 U.S.C. § 371 of International Application No. PCT/GB2019/053595, filed Dec. 17, 2019, which relates to and claims priority to British Patent Application Serial No GB1820618.5, filed Dec. 18, 2018, both of which are incorporated herein by reference in their entirety.

TECHNICAL FIELD OF THE INVENTION

The present invention relates to a protective knee pad and to a kit comprising a knee support and one or more interchangeable protective members.

BACKGROUND TO THE INVENTION

Kneeling can be an awkward working position, but in some occupations keeping close to the floor for long periods of time is required. Such occupations include but are not limited to construction workers, bricklayers, roofers, carpenters, carpet, tile or floor installers, mechanics, plumbers and electricians. Working on the knees without protection can lead to discomfort and continuous pressure on the knees is also known to increase the risk of chronic diseases and cartilage damage. Moreover, if the knees are not protected, there is an increased risk of injury if the knee comes into contact with sharp objects present on the floor on which they are working.

For these reasons, it is common place for individuals who spend prolonged periods of time working on their knees, typically on hard surfaces, to wear knee pads in order minimise discomfort and the risk of injury. Various knee pad constructions are available but most comprise a rigid outer shell or padding which is arranged over the knee and held in place by a pair of spaced apart straps.

However, the use of knee pads with spaced apart straps which encircle a person's leg above and below the knee are known to restrict the flow of blood, which in turn can lead to increased levels of discomfort and in certain cases lower limb disorders. It will also be appreciated that this problem will be exacerbated when an individual wearing the knee pad is working in the kneeling position.

An alternative means for protecting an Individual's knees involves incorporating pockets into the legs of an Individual's work trousers into which protective pads can be inserted. While this may ameliorate the problems associated with knee pads comprising straps, the unprotected pockets are easily damaged meaning that an Individual's work trousers must be replaced on a regular basis. Such knee pad trousers also suffer from the disadvantage that the knee pad, which typically comprises a foam material, may become deformed as result of several washing and drying cycles. As a consequence, the knees may be provided with inadequate protection and the deformed pad could even lead to the individual experiencing increased levels of discomfort.

In light of the above it is an object of embodiments of the present invention to provide an improved knee pad for workmen which overcomes the disadvantages of known knee pads and knee pad systems.

It is also an object of embodiments of the present invention to provide a knee pad for workmen that is comfortable to wear and readily adjustable to fit a variety of body types and sizes.

It is a further object of embodiments of the present invention to provide a knee pad that maintains its position in use without substantially restricting the flow of blood flow in and around the knee region.

It is another object of embodiments of the present invention to provide a knee pad that ensures that the force of an impact, e.g. as an individual kneels down or shuffles along the floor on his/her knees, is distributed throughout the knee pad so that the impact experienced by the knees is minimised.

SUMMARY OF THE INVENTION

According to a first aspect of the invention there is provided a protective knee pad for workmen, the protective knee pad comprising a knee support and a protective member, said knee support comprising a front portion and a rear portion, wherein the knee support is adapted to be wrapped around a user's knee and the protective member comprises a plurality of interconnected overlapping plates.

The rear portion may be detachably secured to the front portion. In particular, an outer surface of the front portion and an inner surface of the rear portion may comprise fastening means for detachably securing the rear portion to the front portion.

The interconnected overlapping plates may be aligned along a backing member. The backing member may extend along the length of the protective member. In particular, the backing member may extend centrally along the interlocking overlapping plates of the protective member.

The protective member may be detachably secured to the front portion of the knee support. In particular, the front portion and an exposed surface of the backing member may comprise fastening means for detachably securing the protective member to the front portion. This enables the protective member to be easily and quickly exchanged for another protective member having different properties.

The fastening means for the protective member may be stitched to or otherwise permanently attached to the exposed surface of the backing member. In some embodiments. The fastening means may be attached to the backing member using double sided adhesive tape.

The backing member may be elasticated. This enables the backing member to flex with an Individual's knees which affords greater comfort to an individual wearing the knee pad. Alternatively, the backing member may be non-elasticated.

The interconnected overlapping plates may be threadably mounted along the backing member. In particular, each plate may comprise at least two aligned slots through which the backing member may be threaded. In some embodiments each plate may comprise two pairs of slots.

In some embodiments the interconnected overlapping plates may be aligned along two or more backing members. The backing members may be spaced apart along the length of the interlocking overlapping plates. The backing members may be disposed centrally along the interconnected overlapping plates of the protective member.

Each plate of the protective member may have a generally V-shaped profile. Each plate may comprise a ridge. The ridge may be located in a central region of the plate. The ridge may extend between a top edge and a bottom edge of each plate. Each plate may be elongate.

In some embodiments the plates may be formed from rubber or a thermal plastic rubber (TPR) material.

In some embodiments the plates may be formed from thermoplastics such as thermoplastic polyurethane (TPU), high-density polyethylene (HDPE) or silicone.

In some embodiments the plates may be formed from a heat-resistant material. In particular, the heat resistant material may comprise an aromatic polyamide such as aramids. In other embodiments the plates may be formed from an aromatic polyamide such as Kevlar.

In some embodiments the plates may comprise graphene.

The plates may alternatively be formed from or coated with strain-rate sensitive polymers that stiffen momentarily while absorbing energy, i.e. on impact.

The protective knee pad may comprise a cover for the protective member. The cover may be detachably secured to the front portion of the knee support. In particular, the front portion and the cover may comprise fastening means for detachably securing the cover to the front portion. An individual may choose to apply the cover over the protective member in adverse weather conditions in order to prevent the protective member from becoming wet for example.

The cover may be weather and/or waterproof. In some embodiments the cover may comprise a water-resistant or a waterproof material. The water-resistant or waterproof material may be attached to an inner surface of the cover. The water-resistant or waterproof material may be resistant to abrasions. The water-resistant or waterproof material may be surrounded by the cover's fastening means for detachably securing the cover to the front portion. The water-resistant or waterproof material may be provided in the form of a continuous web or sheet. The continuous web or sheet does not comprise holes or openings since the presence of holes or openings would compromise the cover's ability to keep to the protective member dry in adverse weather.

In some embodiments the continuous web or sheet may comprise a fabric. In particular, the continuous web or sheet may comprise a Cordura® fabric material.

The fastening means may extend across or cover a major portion of the front portion. In particular, the fastening means may extend across or cover the front portion in its entirety. Such an arrangement means that the rear portion and the protective member can be secured to the front portion at the same time.

When the cover is detachably secured to the front portion to shield the protective member, the rear portion may be adapted to be detachably secured to the cover rather to than to the front portion. Accordingly, the rear portion is indirectly secured to the front portion via the cover. In particular, an outer surface of the cover may be provided with fastening means that are adapted to engage with the fastening means present on the inner surface of the rear portion. The fastening means may be provided on one or more strips attached to the outer surface of the cover. The strips may be stitched to the outer surface of the cover or otherwise permanently attached to the outer surface of the cover.

The fastening means may comprise hook and loop fastening means. In particular, the fastening means may comprise VELCRO®. For example, the front portion may be provided with a loop fabric while the rear portion, protective member and cover may each comprise a corresponding hook fabric. While hook and loop fastening means are preferred, it will be appreciated that any other suitable fastening means could be used.

The knee support may be strapless.

The front portion may comprise a cushion member. The cushion member may comprise a foam material. In particular, the cushion member may comprise an outer foam material and an inner foam material that faces an individual's knee in use. The foam materials may be laminated or otherwise held together to prevent relative movement between the foam materials. In particular, the foam materials may comprise a nitrile butadiene rubber (NBR) foam material and a styrene-butadiene rubber (SBR) foam material.

In some embodiments the front portion may comprise two or more cushion members. In one embodiment the front portion may comprise three cushion members. Each cushion member may be sealed within respective pockets formed on the inner surface of the front portion. The thickness of the cushion members may be varied. When multiple cushion members are present the cushion members may be arranged so that thicker cushion members are positioned over areas of the knee that are known to experience the greatest impact as an individual kneels down or shuffles along the floor on their knees. Alternatively, the front portion may comprise a single cushion member and its thickness may be varied along its length and/or width to ensure that areas of knee that experience the greatest impact are adequately protected.

The rear portion of the knee support may be elasticated. In some embodiments the rear portion may be formed from an elasticated mesh material. For example, the rear portion may comprise an elastic material and a polymer such as polyester.

The rear portion of the knee support may comprise an aperture. The presence of an aperture relieves the pressure being exerted at the rear of the knee so as not to restrict blood flow in or around that region. It also helps to reduce crimping of the rear portion thereby improving comfort while the knee support is being worn.

The rear portion of the knee support may comprise one or more tabs. The tabs may be spaced apart along the free end of the rear portion. In some embodiments the rear portion may comprise two tabs. One tab may be located in an upper region of the knee support while the other tab may be located in a lower region of the knee support. The tabs may be reflective or photoluminescent.

The knee support may comprise a gripping band or a plurality of spaced apart gripping members. The gripping band or gripping members may be provided on an inner surface of the front portion and/or on an inner surface of the rear portion such that when the rear portion is detachably secured to the front portion the gripping band or gripping members face a user's knee. The gripping band or gripping members prevent or at least reduce movement of the knee support along an Individual's leg so that the protective member is held in position over a user's knee. The gripping band or gripping members may extend across an upper region and/or a lower region of the knee support.

The gripping band or gripping members may be elasticated. The gripping band or gripping members may comprise a non-slip material. For example, the gripping band or gripping members may comprise an elastic material and a polymer, e.g. polyester. In some embodiments the gripping band or gripping members may comprise silicone.

The protective knee pad is preferably resistant to a force of at least 250 N according to European Standard EN14404: 2004+A1:2010.

According to a second aspect of the invention there is provided a kit comprising a knee support adapted to be wrapped around a user's knee and a protective member detachably secured to the knee support.

The kit according to the second aspect of the invention may comprise a knee support incorporating any or all of the features described in relation to the knee support of the first aspect of the invention.

The kit may comprise a protective member incorporating any or all features described in relation to the protective member of the first aspect of the invention.

The kit may comprise a cover for the protective member. The cover may be detachably secured to the knee support. The cover may incorporate any or all features described in relation to the cover of the first aspect of the invention.

DETAILED DESCRIPTION OF THE INVENTION

In order that the invention may be more clearly understood one or more embodiments thereof will now be described, by way of example only, with reference to the accompanying drawings, of which:

Figure 1:
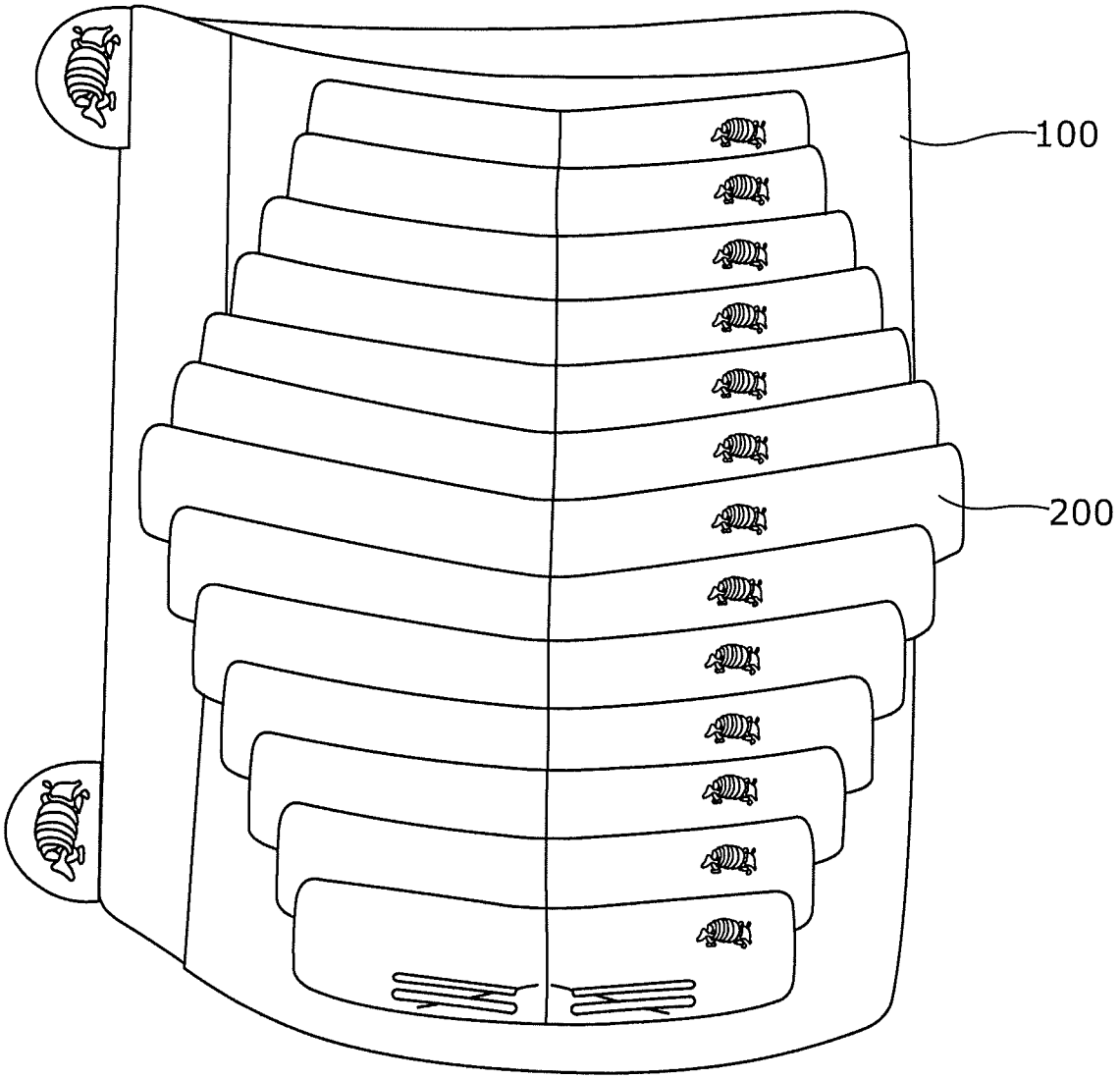
FIG. 1 shows a front view of the protective knee pad in which the protective member is attached to the knee support.

A protective knee pad 1 in accordance with the present invention is shown in FIG. 1. The protective knee pad 1 comprises a knee support 100 and a protective member 200.

Figure 3:
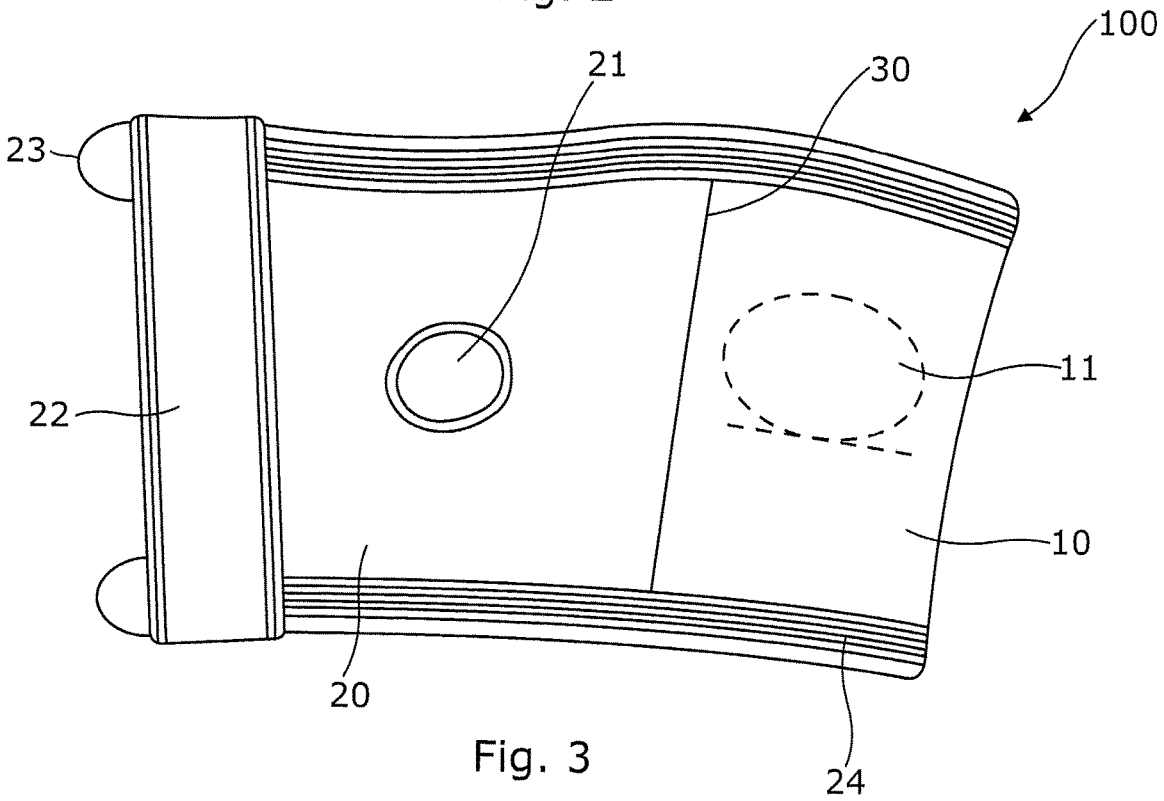
FIG. 3 shows a rear view of the knee support shown in FIG. 2.

As best shown in FIG. 3 the knee support 100 comprises a front portion 10 and a rear portion 20 which is joined to the front portion 10 at a fold line 30. A loop closure fabric such as velvet is permanently secured to the outer surface of the front portion 10. The velvet may comprise natural fibres and/or synthetic fibres. In this embodiment the loop closure fabric comprises polyester. The loop closure fabric covers most of, if not all of the outer surface of the front portion 10 to provide a large surface on to which the protective member 200 and the rear portion 20 can be attached.

A fabric layer is stitched to the inner surface of the front portion 10 around its periphery to define a cavity that is adapted to receive a cushion member 11. The cushion member 11 in this embodiment comprises an outer foam layer and an inner foam layer which faces a user's knee in use. The outer foam layer comprises nitrile butadiene rubber (NBR) foam while the inner foam layer comprises styrene-butadiene rubber (SBR) foam. The thickness of the outer and inner foam layers is 1.2 cm and 0.5 cm respectively. In some embodiments the cavity is adapted to house multiple cushion members 11 in a corresponding number of discrete pockets. The thickness of the cushion members is varied so that thicker cushion members 11 are positioned over areas of the knee that are known to experience the greatest impact.

Figure 2:
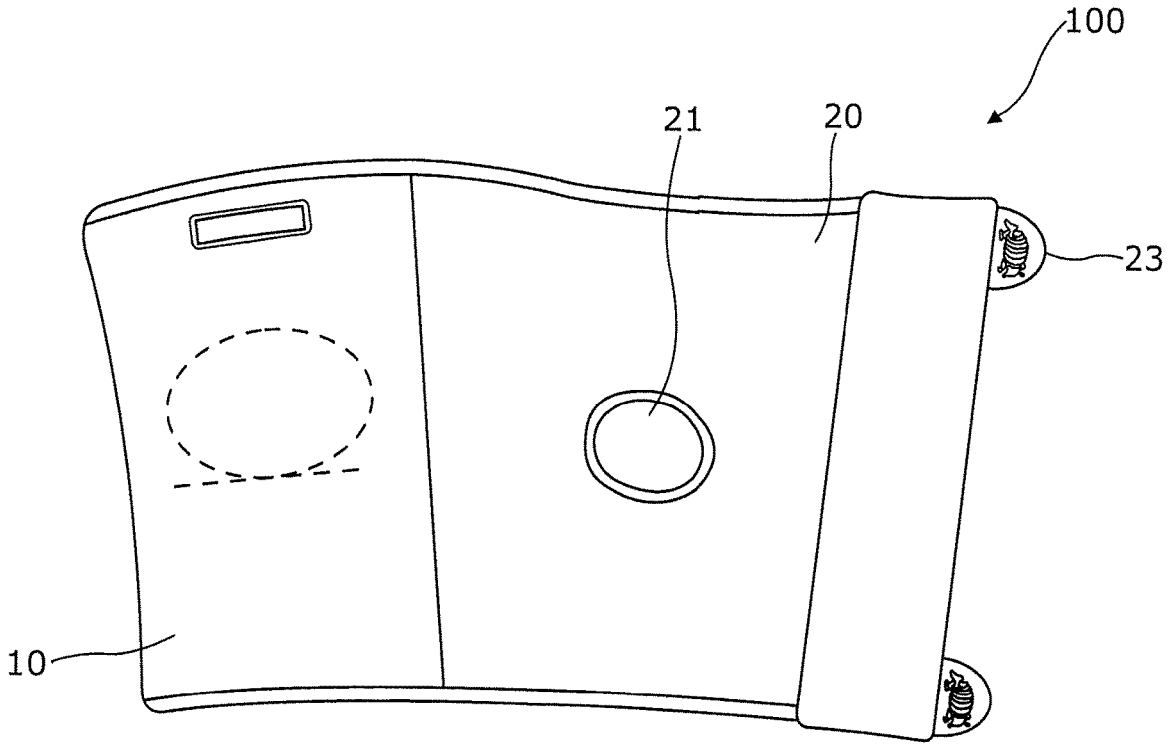
FIG. 2 shows a front view of a knee support in accordance with the present invention.

The rear portion 20 is elasticated and is formed from a stretch-mesh material comprising a mixture of elastic and polyester. As best shown in FIGS. 2 and 3 an aperture 21 is provided in a central region of the rear portion and is positioned to face the rear of a user's knee in use. The aperture 21 helps reduce crimping of the rear portion 20 thereby improving comfort while the protective knee pad 1 is being worn by an individual.

A strip of hook closure fabric 22, e.g. nylon, is permanently secured along the side edge of the rear portion by stitching. However, it will be appreciated that in other embodiments the strip 22 may be replaced by a plurality of hook closure fabric strips (not shown) that are spaced apart and extend along the side edge of the rear portion 20. This arrangement enables the rear portion 20 to be detachably secured to the front portion 10 comprising the loop fabric material. The knee support 100 additionally comprises two closure tabs 23 that are secured between the inner surface of the rear portion 20 and the strip 22 of hook closure fabric. The tabs 23 are formed from a plastics material such as polyvinyl chloride (PVC). The tabs 23 in this embodiment have a generally semi-circular profile. The tabs 23 facilitate wrapping and un-wrapping of the knee support 100 around a user's knee.

As best shown in FIG. 3, two gripping bands 24 extend between the side edge of the front portion 10 and the strip 22 of hook closure fabric provided on the inner surface of the rear portion 20. The gripping bands 24 are formed from a non-slip material to prevent or at least reduce movement of the knee support 100 when being worn by an individual. In particular, the gripping bands 24 comprise a mixture of elastic and polyester.

Figure 4:
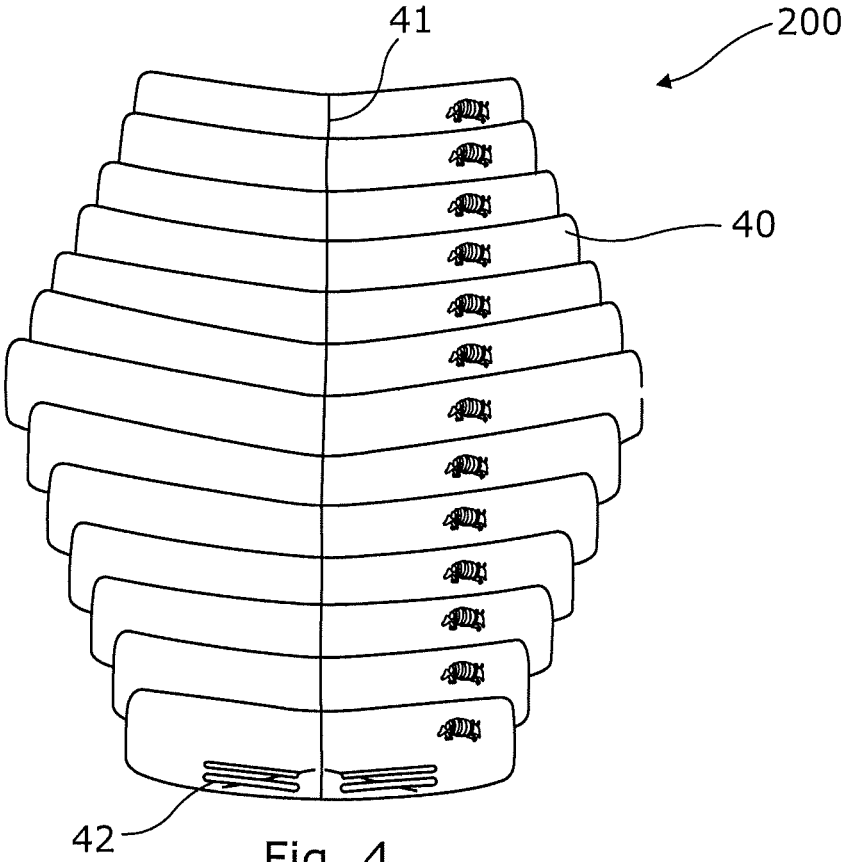
FIG. 4 shows a front view of the protective member in accordance with the present invention.
Figure 5:
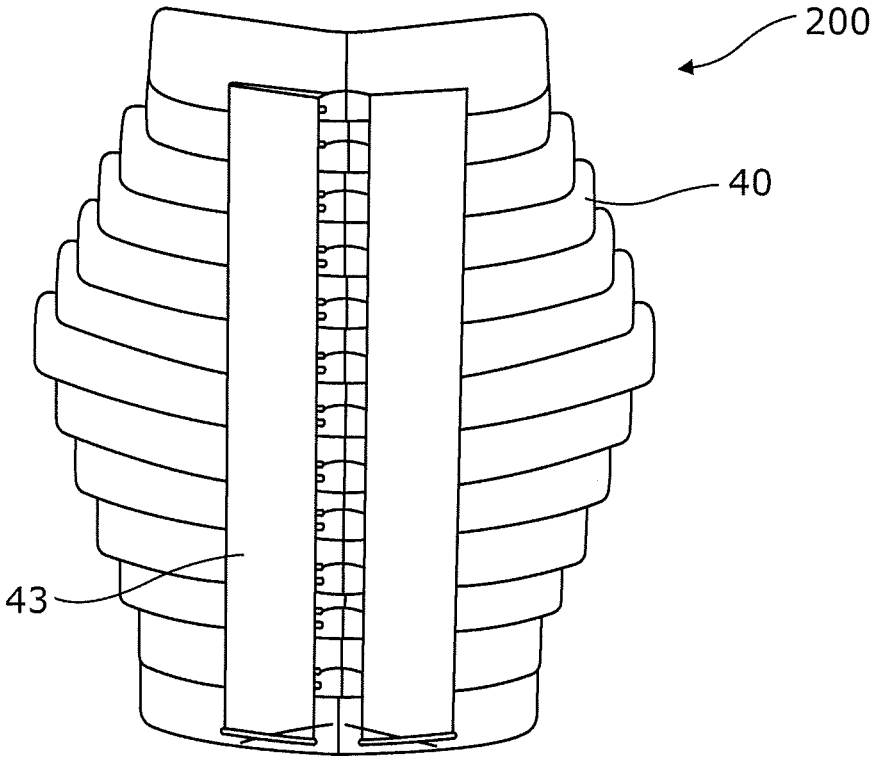
FIG. 5 shows a rear view of the protective member shown in FIG. 4.
Figure 6:
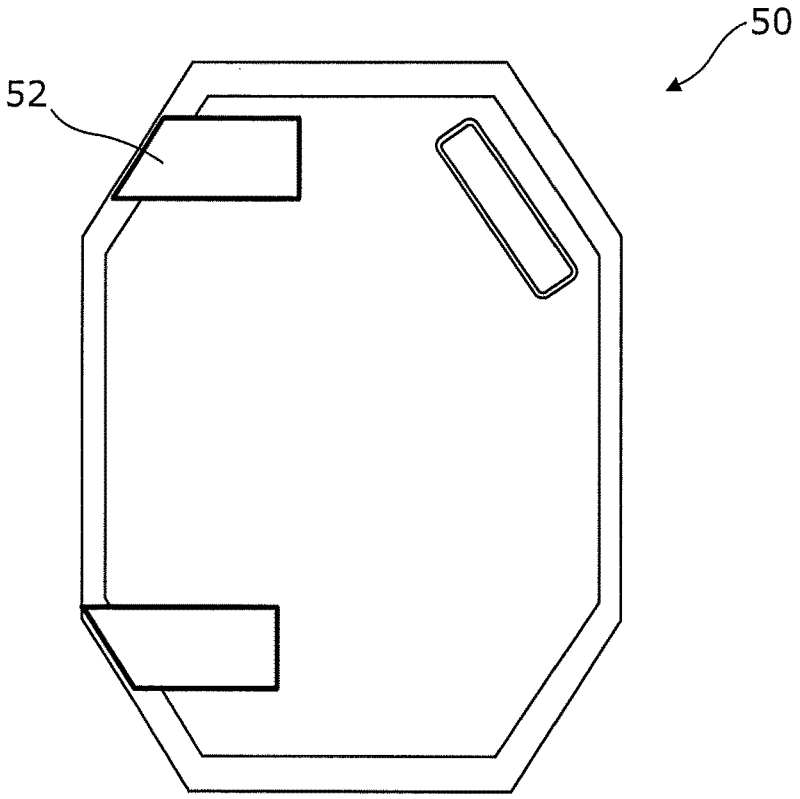
FIG. 6 shows a front view of a cover in accordance with the present invention.
Figure 7:
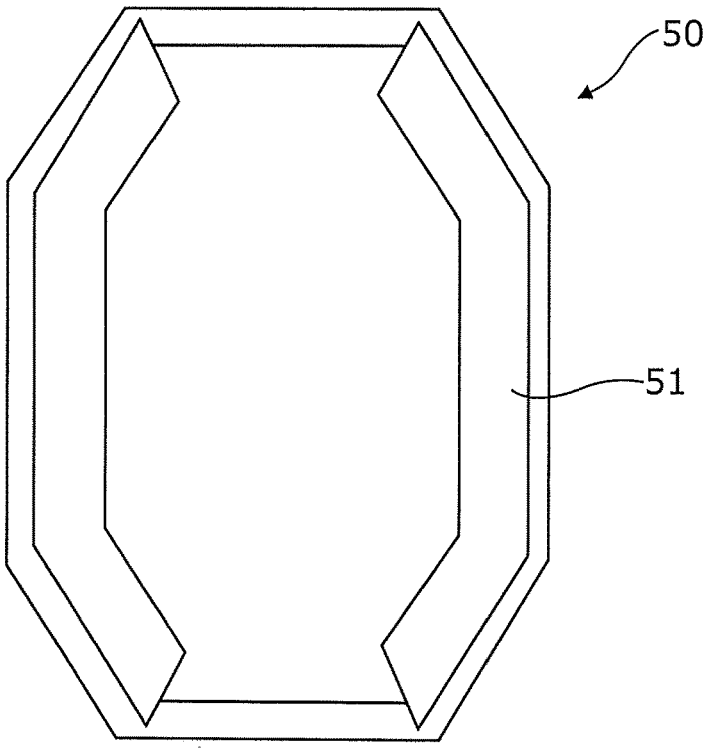
FIG. 7 shows a rear view of the cover shown in FIG. 6.

The protective member 200 of the present invention comprises a plurality of interconnected overlapping plates 40 that are adapted to conform to the shape of an individual's knee. Each plate 40 is elongated and has a generally v-shaped profile. The protective member 200 comprises interconnected overlapping plates 40 of varying widths. In particular, FIG. 4 shows that the protective member 200 comprises thirteen plates 40 and that six plates 40 are provided above and below a central plate having the greatest width dimension. It can also be seen that the plate 40 width reduces incrementally from the central plate towards the outermost plates of the protective member 200.

Each plate 40 comprises a central ridge 41 and two pairs of slots 42 (one pair either side of the ridge) that are adapted to threadably receive respective backing members 43. Each backing member 43 may be elasticated so as to allow the backing members 43 and the interconnected overlapping plates 40 to flex as an individual wearing the protective knee pad 1 moves from a standing position to a kneeling position and vice-versa. To secure the plates 40, each end of the backing member 43 is threaded through the slots 42 in the outermost plates 40, is folded back on itself and then stitched to the main body of the backing member 43. Each backing member 43 may be formed from or provided with a hook fabric material for detachable engagement with the loop fabric material covering the outer surface of the front portion 10. This arrangement means that the protective member 200 can be substituted for another protective member 200 easily and quickly when desired. The hook fabric material in this embodiment is stitched to the free surface of the backing member 43, although it will be appreciated that alternative attachment means could be used to secure the hook fabric to the backing member 43, e.g. a layer of double-sided adhesive tape.

In this embodiment the plates 40 are formed from high density polyethylene (HDPE), which enables the protective member 200 to resist a force of at least 250 N according to European Standard EN14404:2004+A1:2010. It should be noted however, that it is not the material choice alone that enables the protective member 200 to resist forces of at least 250 N, it is a combination of the material choice and the way in which the plates 40 are arranged, i.e. the overlapping plate 40 configuration, which ensures that impacts in the knee region are distributed throughout the protective member 200 over a large surface area.

In another embodiment, the plates 40 of the protective member 200 are formed from a non-slip material such as thermal plastic rubber or thermoplastic polyurethane in which case the protective member 200 is particularly suited for workmen such as roofers. In other embodiments the plates 40 are formed from or provided with a coating that is resistant to oil or certain chemicals which would otherwise degrade the plates 40 under normal circumstances. Accordingly, such protective members 200 are particularly suitable for use by individuals who work in the oil and chemical industries. Similarly, in another embodiment the plates 40 are formed from or coated with a flame-resistant material in which case the protective member 200 could be used by fireman for example.

In this embodiment of the invention there is provided a cover 50 for the protective member 200. The cover is formed from nylon and has a substantially octagonal cross-section. The inner surface of the cover 50 is provided with a water-resistant or waterproof material, e.g. a Cordura® fabric. The inner surface of the cover is also provided with strips 51 of hook fabric along some or all of its edges for detachably engaging the loop fabric covering the front portion 10. In contrast, the outer surface of the cover 50 is provided with two spaced apart strips 52 located above and below one of the cover's longitudinal edges. The strips 52 comprise a loop fabric material and extend inwardly from an angled edge of the cover 50. This arrangement enables the cover 50 to be detachably secured to the front portion 10 and the rear portion 20 to be detachably secured to the cover 50 when present.

The knee support 100 is adapted to be wrapped around an Individual's knee, meaning the that the knee support 100 can be readily adjusted to conform to a variety of leg sizes and/or to accommodate an individual wearing a pair of workman's trousers. Accordingly, the protective knee pad 1 of the present invention offers improved comfort over conventional knee pads having elasticated sleeve knee supports or knee supports comprising straps which bite into the legs and restrict blood flow.

The knee support 100 and a protective member 200 may be provided separately but, in this embodiment, they form part of a kit. It will be appreciated that the kit may additionally comprise the cover 50 for the protective member and/or one or more additional protective members 200. The interchangeability of the protective members 200 means that the protective knee pad 100 can be used by a variety of workmen in a variety of environments.

The one or more embodiments are described above by way of example only. Many variations are possible.

The invention claimed is:

1. A protective knee pad for workmen, the protective knee pad comprising a knee support and a protective member comprising a plurality of interconnected overlapping plates, said knee support comprising a front portion positioned to cover the front of a user's knee in use and a rear portion which is detachably securable to the front portion, wherein the knee support is strapless and adapted to be wrapped around a user's knee, the rear portion comprises an aperture in a central region of the rear portion, the aperture is positioned to face the rear of a user's knee when the pad is in use, and the rear portion outside of the aperture is sized to cover a majority of the surface area of the back of a user's knee, wherein an outer surface of the front portion and an inner surface of the rear portion comprise fastening means for detachably securing the rear portion to the front portion, wherein the fastening means is sized to cover a majority of the outer surface of the front portion and to extend from a fold line arranged at a first side of the user's knee to a free end of the front portion arranged at a second side of the user's knee, the front portion allowing attachment of the protective member and the rear portion to the front portion at any lateral position along the front portion, wherein a gripping band is provided on an inner surface of the front portion and on an inner surface of the rear portion to reduce movement of the knee support in use, wherein the protective member is detachably secured to the front portion of the knee support via fasteners arranged along two or more spaced apart backing members arranged on either side of and equidistant from a vertical centerline of the knee support and the fastening means comprises hook and loop fastening means.

2. A protective knee pad according to claim 1, wherein the plates are aligned along the two or more backing members.

3. A protective knee pad according to claim 2, wherein the front portion and an exposed surface of the or each backing member comprises fastening means for detachably securing the protective member to the front portion.

4. A protective knee pad according to claim 1, wherein the protective knee pad comprises a cover for the protective member.

5. A protective knee pad according to claim 4, wherein the cover is detachably secured to the front portion of the knee support.

6. A protective knee pad according to claim 5, wherein the front portion and the cover comprise fastening means for detachably securing the cover to the front portion.

7. A protective knee pad according to claim 4, wherein the cover comprises a water-resistant or waterproof material.

8. A protective knee pad according to claim 7, wherein the water-resistant or waterproof material is provided in the form of a continuous web or sheet.

9. A protective knee pad according to claim 8, wherein the continuous web or sheet is attached to an inner surface of the cover.

10. A protective knee pad according to claim 1, wherein the front portion comprises a cushion member.

11. A protective knee pad according to claim 1, wherein the rear portion of the knee support is elasticated.

12. A protective knee pad according to claim 1, wherein the rear portion of the knee support comprises one or more tabs.

13. A kit comprising the strapless knee support of claim 1 and a protective member detachably secured to the knee support.

14. A kit according to claim 13, wherein the kit comprises a cover for the protective member.

* * * * *